US009627118B2

(12) United States Patent
Anger et al.

(10) Patent No.: US 9,627,118 B2
(45) Date of Patent: Apr. 18, 2017

(54) GAPPED MAGNET CORE

(75) Inventors: Jan Anger, Ludvika (SE); Julia Forslin, Ludvika (SE); Uno Gafvert, Vasteras (SE)

(73) Assignee: ABB Research Ltd., Zurich (CH)

( * ) Notice: Subject to any disclaimer, the term of this patent is extended or adjusted under 35 U.S.C. 154(b) by 1003 days.

(21) Appl. No.: 13/187,241

(22) Filed: Jul. 20, 2011

(65) Prior Publication Data

US 2011/0309905 A1 Dec. 22, 2011

Related U.S. Application Data

(63) Continuation of application No. PCT/EP2009/067323, filed on Dec. 16, 2009.

(30) Foreign Application Priority Data

Jan. 20, 2009 (EP) ..... 09150901

(51) Int. Cl.

| | |
|---|---|
| ***H01F 27/24*** | (2006.01) |
| ***H01F 3/14*** | (2006.01) |
| ***H01F 27/26*** | (2006.01) |
| ***H01F 41/02*** | (2006.01) |
| *H01F 27/08* | (2006.01) |
| *H01F 37/00* | (2006.01) |

(52) U.S. Cl.

CPC ..... *H01F 3/14* (2013.01); *H01F 27/263* (2013.01); *H01F 41/0206* (2013.01); *H01F 27/08* (2013.01); *H01F 37/00* (2013.01); *Y10T 29/49075* (2015.01)

(58) Field of Classification Search

USPC ..... 336/212, 214, 233, 83, 178

See application file for complete search history.

(56) References Cited

U.S. PATENT DOCUMENTS

| | | | | |
|---|---|---|---|---|
| 1,560,934 | A * | 11/1925 | Gerald | 361/64 |
| 2,599,182 | A * | 6/1952 | Kerns | 336/182 |
| 2,600,057 | A * | 6/1952 | Kerns | 336/172 |
| 2,909,742 | A * | 10/1959 | Lamberton | 336/212 |
| 5,062,197 | A * | 11/1991 | Ngo et al. | 29/606 |
| 5,400,005 | A * | 3/1995 | Bobry | 336/83 |
| 5,748,013 | A * | 5/1998 | Beauclair et al. | 336/233 |
| 6,512,438 | B1 * | 1/2003 | Yoshimori et al. | 336/178 |
| 6,873,239 | B2 * | 3/2005 | Decristofaro et al. | 336/178 |
| 6,906,608 | B2 * | 6/2005 | Fujiwara et al. | 336/110 |
| 7,317,374 | B2 * | 1/2008 | Flanders et al. | 336/220 |

(Continued)

FOREIGN PATENT DOCUMENTS

| | | |
|---|---|---|
| CA | 1034646 A | 7/1978 |
| DE | 3203196 A1 | 8/1983 |

(Continued)

OTHER PUBLICATIONS

International Search Report and Written Opinion of the International Searching Authority; PCT/EP2009/067323; Mar. 25, 2010; 7 pages.

*Primary Examiner* — Alexander Talpalatski
*Assistant Examiner* — Joselito Baisa
(74) *Attorney, Agent, or Firm* — Whitmyer IP Group LLC

(57) ABSTRACT

A gapped core leg for a shunt reactor, comprising magnetic core elements separated by spacers cast directly between the core elements. Accordingly, a rigid core leg construction is achieved.

8 Claims, 3 Drawing Sheets

(56) References Cited

U.S. PATENT DOCUMENTS

| | | | | |
|---|---|---|---|---|
| 7,353,587 | B2 * | 4/2008 | Vinciarelli et al. | 29/602.1 |
| 7,449,985 | B2 * | 11/2008 | Urano et al. | 336/178 |
| 2002/0024413 | A1 | 2/2002 | De Graaf et al. | |

FOREIGN PATENT DOCUMENTS

| | | | |
|---|---|---|---|
| EP | 0075164 | A1 | 3/1983 |
| GB | 1571057 | A | 7/1980 |
| JP | 58128709 | A | 8/1983 |

* cited by examiner

GAPPED MAGNET CORE

CROSS-REFERENCE TO RELATED APPLICATIONS

The present application is a continuation of pending International patent application PCT/EP2009/067323 filed on Dec. 16, 2009 which designates the United States and claims priority from European patent application 09150901.8 filed on Jan. 20, 2009, the content of which is incorporated herein by reference.

FIELD OF THE INVENTION

The present invention relates to a core leg for a shunt reactor, wherein magnetic core elements of the leg are separated by spacers between the core elements. The present invention also relates to manufacturing of a core leg with spacers.

BACKGROUND OF THE INVENTION

A shunt reactor is an inductive device which has an important function of compensating capacitive generation in a high voltage power transmission system. In a gapped core type of reactor a subdivided core leg comprising magnetic core elements is provided inside the reactor winding. This core leg functions as a carrier and director of the magnetic flux, thereby enabling high energy density and an advantageous operation of the reactor at higher system voltages.

A conventional core leg comprises a stack of magnetic core elements separated by spacer elements such as ceramic spacers. The core elements may be in the form of cylindrical segments of laminated core steel sheets, and the material of the spacer elements may be steatite or alumina. Typical spacer elements are cylinder-shaped and fill the core gaps to approximately 50-60%, but also hexagonal spacers have been suggested which fill the core gaps to a greater extent. The spacers may be bonded to the core elements with epoxy to form a rigid core leg.

The manufacturing of a core leg with a construction as described above requires high precision and a considerable amount of craftsmanship. When the ceramic spacers are bonded onto the core steel cylinder with epoxy, the tops of the spacers are planed to ensure an even surface before stacking the next core element. The machining of the ceramic spacers is difficult and expensive, and assemblage of the core leg segment by segment is very time-consuming. Moreover, the great number of manual manufacturing steps is leading to decreased precision of the construction causing increased sound level of the reactor and deformation of the gaps and core elements during operation. From the sound level point of view, it would also be desirable to increase the rigidity of the core leg.

One example of a gapped core leg construction is known from CA1034646, wherein the use of hard spacer material such as Micarta®, which is a composite of linen or paper fabric in a thermosetting plastic, is suggested.

JP58128709 discloses a core leg spacer in form of a disc having a diameter corresponding to that of the core elements. The spacer disc consists of resin-impregnated fibres, and the use of this type of spacer is aimed at facilitating the assembly of a shunt reactor core leg. A problem with using a large disc as a spacer is that it is difficult to get the mating surfaces of the disc and the core elements to match perfectly.

SUMMARY OF THE INVENTION

One object of the invention is thus to provide a gapped core leg for a shunt reactor which is simple to manufacture, and which has improved precision, increased rigidity and reduced sound level compared to known gapped core legs. It is a further object of the invention to provide a simple method for manufacturing a gapped core leg, which method leads to an improved end product.

These objects are achieved by a gapped core leg for a shunt reactor and the method for manufacturing a gapped core leg for a shunt reactor.

According to one embodiment of the invention, there is provided a gapped core leg for a shunt reactor, the gapped core leg comprising: a plurality of core elements arranged in a stacked manner, and a spacer arranged in a gap between adjacent core elements, wherein the spacer is directly cast between the adjacent core elements.

The invention is based on the realization that by casting the spacers directly between the adjacent core elements a number of earlier manufacturing steps can be avoided, thus resulting in a simplified manufacturing of a gapped core leg while at the same time it becomes easier to keep the manufacturing tolerances. The direct casting method leads to a strong adhesion and a large contact area between the core element and the direct cast spacer, and shows thereby further advantages such as a more rigid construction of the core leg.

According to one embodiment of the invention, the direct cast spacer comprises a polymer composite. It has been established that by a correct choice of spacer material, not only an improved manufacturing cycle but also increased rigidity and reduced sound level are achieved.

According to one embodiment of the invention, the polymer composite is a polymer concrete. Polymer concrete has been found to be a preferred material because of its high compressive strength, good adhesion properties, long-term durability in severe heat and severe cold conditions, low permeability to water, good resistance against corrosion and low price.

According to one embodiment of the invention, the direct cast spacer has two main surfaces and a side surface, the side surface comprising through holes across the direct cast spacer. The worsened cooling properties resulting from completely filling the gap between adjacent core elements with material can be compensated by providing the direct cast spacers with through holes through which a cooling medium may flow.

According to one embodiment of the invention, the through holes are running in two levels adjacent to each main surface of the direct cast spacer. The heat is generated in the core elements and for effective cooling the through holes should run as close to the heat sources as possible.

According to the invention, there is provided a method for manufacturing a gapped core leg for a shunt reactor, the method comprising: arranging a plurality of core elements in a mould in a stacked manner, and providing a gap between adjacent core elements with a direct cast spacer by casting spacer material directly between adjacent core elements.

According to one embodiment of the invention, a plurality of direct cast spacers are cast in one shot. By casting in one shot the manufacture not only becomes faster but also leads to better precision and more uniform end products.

According to one embodiment of the invention, at least one distance piece is arranged in the gap between adjacent core elements before casting. The at least one distance piece helps to define correct core element distance until the direct cast spacer is cast.

According to one embodiment of the invention, the number of distance pieces in the gap between adjacent core elements is at least three. With three or more distance pieces a steady support for the individual core elements is provided.

According to one embodiment of the invention, the mould is provided with an individual radial gate for each gap between adjacent core elements which is to comprise a direct cast spacer. By an individual gate for each gap to be cast, a complete filling of the gap is ensured while enabling a fast casting process.

According to one embodiment of the invention, the mould is provided with a common gate for several gaps between adjacent core elements, and at least one core element is provided with a through hole to connect the gaps on both sides of the core element. By providing at least one core element with a through hole, it is possible to use a simple mould with a reduced number of gates.

According to one embodiment of the invention, the gap between adjacent core elements is provided, before casting, with tubes or pipes across the gap through a surface corresponding to a side surface of the direct cast spacer. By this method, through holes crossing a side surface of the direct cast spacer are easily obtained.

BRIEF DESCRIPTION OF THE DRAWINGS

The invention will be explained in greater detail with reference to the accompanying drawings, wherein.

DETAILED DESCRIPTION OF THE INVENTION

Figure 1:
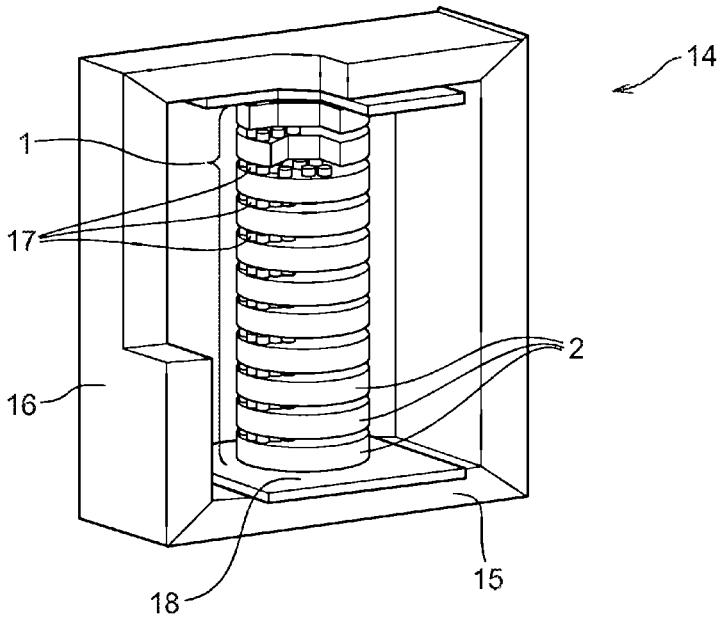
Fig. 1 (Prior Art)
FIG. 1 shows a typical prior art shunt reactor core frame with a gapped core leg installed between two yokes and two side legs.
Figure 2:
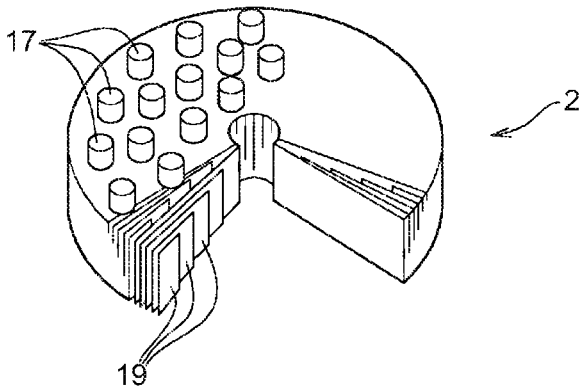
Fig. 2 (Prior Art)
FIG. 2 shows a cylindrical core element of a prior art shunt reactor with ceramic spacers glued on one face of the core element.

In a prior art shunt reactor core frame 14 of FIG. 1, a gapped core leg 1 is positioned between two yokes 15 and two side legs 16. The core leg 1 comprises a plurality of core elements 2 arranged in a stacked manner. The core elements 2 are spaced apart by a large number of cylinder-shaped ceramic spacers 17 provided in each gap between adjacent core elements 2. The magnetic connection between the yokes 15 and the core leg 1 is obtained via so-called cross flux plates 18. The core elements 2 comprise radial laminated core steel sheets 19 according to FIG. 2, the lamination blocks being moulded in epoxy resin to form solid pieces. The ceramic spacers 17 are glued on one face of the core elements 2 before stacking the core elements 2.

Figure 3:
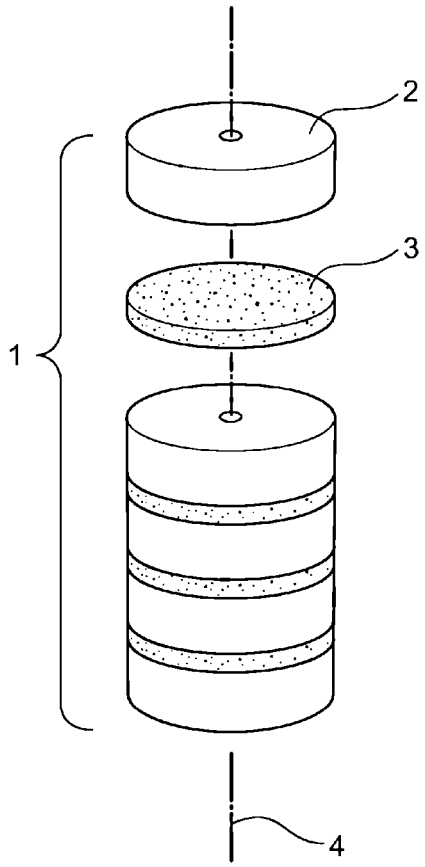
FIG. 3 shows a gapped core leg according to one embodiment of the present invention.

FIG. 3 shows a gapped core leg 1 according to one embodiment of the invention with a plurality of core elements 2 being separated by direct cast spacers 3. In FIG. 3 one of the direct cast spacers 3 appears to be loose, but this is only for the purpose of illustrating that the whole volume between two core elements 2 is filled with the spacer material. In reality the direct cast spacers 3 have a strong adhesion with the core elements 2 as a result of the direct casting method. In one preferred embodiment all the spacers 3 are of the direct cast type, but using other types of spacers in some of the gaps might turn out to be desirable. This could e.g. be because of worsened cooling properties of the core leg 1 when the gaps are completely filled with material. Ceramic spacers 10 and other prior art solutions may be used in some of the gaps when desired.

The outermost core elements 2 of the core leg 1 may be machined after casting in order to bring the dimensions of the core leg 1 within desired tolerances. It is also possible to allow direct cast spacers 3 to be the outermost elements of the core leg 1, especially if this is preferable from the machining point of view.

Figure 4:
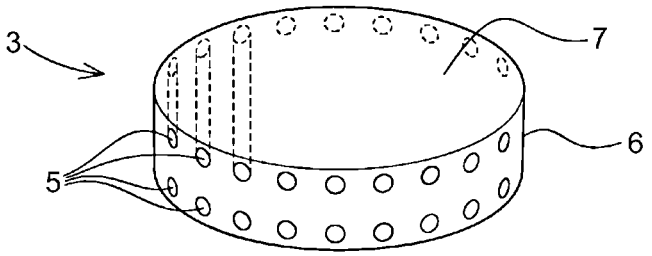
FIG. 4 shows a direct cast spacer element according to one embodiment of the invention.

FIG. 4 shows a direct cast spacer 3 according to one embodiment of the invention. The direct cast spacer 3 has two main surfaces 7 and a side surface 6. The spacer material is preferably a polymer composite such as polymer concrete. In order to improve the rigidity of the direct cast spacers 3 and the core leg 1 as a whole, the spacer material can be reinforced with appropriate material such as glass fibre or carbon fibre. The side surface 6 of the direct cast spacers 3 is provided with through holes 5 in order to improve the cooling properties. The through holes 5 are accomplished by, before casting, providing the corresponding gaps between adjacent core elements 2 with tubes or pipes across the gap through a surface corresponding to the side surface 6 of the direct cast spacer 3. Preferably the tubes or pipes function at the same time as reinforcement such that no additional reinforcement is needed. The through holes 5 are preferably located close to the core elements 2, and they are preferably running in two levels adjacent to each main surface 7 of the direct cast spacer 3.

With an appropriate casting arrangement a plurality of direct cast spacers 3, preferably all of them, can be cast in one shot. This means in practice that the gaps are filled in parallel and no pressure difference between the gaps can occur. This has significance if an excessive pressure is used during the casting which might cause deformation or displacement of the core elements 2. Casting in one shot entails an additional advantage of a fast manufacturing cycle.

Figure 5:
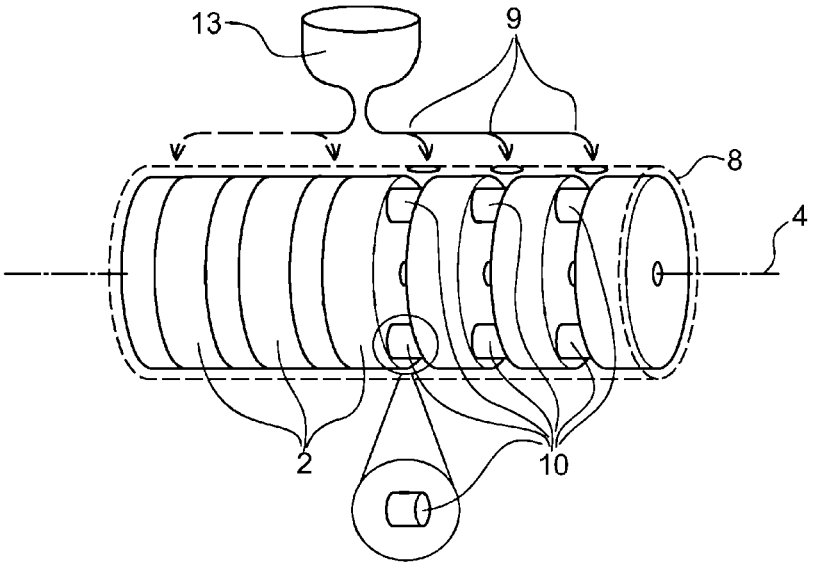
FIG. 5 illustrates a casting arrangement wherein the mould is provided with an individual radial gate for each gap between adjacent core elements.

FIG. 5 shows a casting arrangement according to one embodiment of the invention, wherein the mould 8 is provided with an individual radial gate 9 for each gap between adjacent core elements 2 which is to comprise a direct cast spacer 3. The casting is done by arranging the core elements 2 in a mould 8 in a stacked manner and filling any predetermined gap between adjacent core elements 2 with the spacer material 13. Individual gates 9 enable a fast casting cycle and complete filling of the gaps. In this casting arrangement the axis 4 of the core leg lies preferably substantially horizontally during casting.

The distances between the core elements 2 may be defined before casting by arranging distance pieces 10 in the gaps between adjacent core elements 2, and by keeping the stack tight during casting by applying an appropriate axial force at the outermost core elements 2. Three distance pieces 10 in each gap ensure a steady support for the core elements 2. The distance pieces 10 may be manufactured from the same material as the direct cast spacers 3, but they may also consist of other suitable insulating material.

Figure 6:
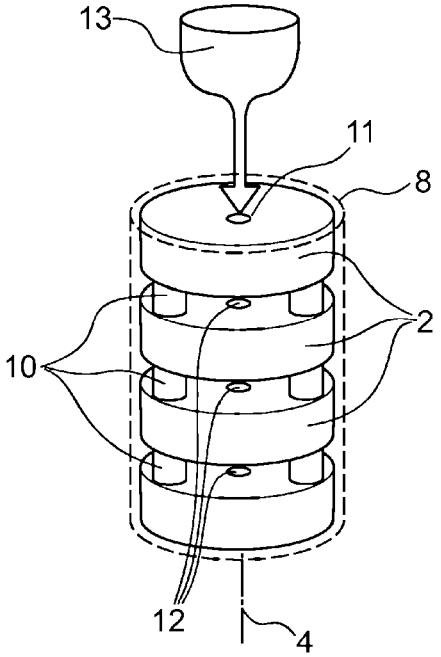
FIG. 6 illustrates a casting arrangement wherein the mould is provided with a common gate for several gaps between adjacent core elements.

FIG. 6 shows a casting arrangement according to another embodiment of the invention, wherein the mould 8 is provided with a common gate 11 for several gaps between adjacent core elements 2. The gaps on both sides of a core element 2 are connected by providing the dividing core element 2 with a through hole 12. All the gaps of the core leg can be connected by through holes 12 when desired, but some gaps may be isolated in order to use an alternative type of spacer in them. In this casting arrangement the axis 4 of the core leg is preferably substantially vertical during casting, and the common gate 11 is placed in an axial end of the mould 8. Placing the gate 11 at the top end can be chosen in order to allow gravity to contribute to filling the gaps, and placing the gate 11 at the bottom end can be chosen in order to enhance the extraction of air, whichever placement turns out to be more advantageous. This casting arrangement enables the use of a simple mould 8 with a single gate 11, but the number of gates 11 may be increased when desired. Increasing the number of gates 11 may involve providing both axial ends of the mould 8 with a gate 11, or combining axial gates 11 with radial ones 9.

Vacuum casting can be applied if the presence of air bubbles is considered critical. However, small air bubbles are not expected to be a problem since the mechanical strength is ensured by the massive direct cast spacers 3 and small air bubbles do not affect the electrical properties of the spacer.

The invention is not limited to the embodiments shown above, but the person skilled in the art may modify them in a plurality of ways within the scope of the invention as defined by the claims. For example, while the drawings only show core legs with a circular cross section, any other suitable cross section shapes are possible without departing from the inventive concept of the invention.

What is claimed is:

1. A gapped core leg for a shunt reactor, the gapped core leg comprising:

a plurality of core elements arranged in a stacked manner, and a spacer arranged in a gap between adjacent core elements, characterized in that the spacer is directly cast between the adjacent core elements; and the direct cast spacer has two main surfaces and a side surface, the side surface comprising through holes across the direct cast spacer.

2. The gapped core leg according to claim 1, wherein the direct cast spacer comprises a polymer composite.

3. The gapped core leg according to claim 2, wherein the polymer composite is a polymer concrete.

4. The gapped core leg according to claim 1, wherein the through holes are running in two levels adjacent to each main surface of the direct cast spacer.

5. The gapped core leg according to claim 1, wherein the spacer fills the whole volume between the adjacent core elements.

6. The gapped core leg according to claim 1, further comprising a mould with a plurality of radial gates between adjacent core elements for introducing spacer material.

7. The gapped core leg according to claim 1, further comprising a mould with a common gate for introducing spacer material between adjacent core elements, at least one core element with a through hole to connect gaps on both sides of the core element.

8. The gapped core leg according to claim 1, wherein the core elements are in the form of radial laminated core steel sheets.

* * * * *